United States Patent [19]

La Pierre

[11] Patent Number: 4,941,229

[45] Date of Patent: Jul. 17, 1990

[54] PORTABLE, MOTOR-DRIVEN PAINT ROLLER LOADER

[76] Inventor: Roger La Pierre, 71 Elmwood Ave., Apt. 16, Burlington, Vt. 05401

[21] Appl. No.: 405,164

[22] Filed: Sep. 11, 1989

[51] Int. Cl.[5] ..... B44D 3/12

[52] U.S. Cl. ..... 15/257.06

[58] Field of Search ..... 15/257.05, 257.06, 3; 118/258

[56] References Cited

U.S. PATENT DOCUMENTS

| | | | |
|---|---|---|---|
| 3,135,000 | 6/1964 | Rasmussen | 15/257.06 X |
| 3,409,931 | 11/1968 | Graf | 15/257.06 |
| 4,107,815 | 8/1978 | Dumesnil, Jr. | 15/257.05 |
| 4,164,803 | 8/1979 | Zurawin et al. | 15/257.05 |
| 4,205,411 | 6/1980 | Cupp et al. | 15/257.06 |
| 4,233,705 | 11/1980 | Lepage et al. | 15/257.06 |

*Primary Examiner*—Edward L. Roberts

*Attorney, Agent, or Firm*—Sughrue, Mion, Zinn, Macpeak & Seas

[57] ABSTRACT

An upwardly open, rectangular, box-like casing mounts interiorly a hollow, perforated cylindrical roller assembly for rotation about its axis, positioned horizontally between longitudinally opposed end walls. A drive motor mounted to the casing has a shaft projecting outwardly of a casing end wall with a pully fixed thereto. The axle of the hollow, perforated cylindrical roller assembly has fixed thereto a similar driven pulley. An elastic belt is leaved about respective pulleys such that the hollow, perforated cylindrical roller assembly may be driven by the electric drive motor. The roller assembly includes a hollow tube slidably mounted on the axle and selectively fixed thereto through a set screw to facilitate by removal of the axle, disassembly of the hollow, perforated cylindrical roller assembly from the casing to facilitate cleaning of the casing and the roller assembly. An open mesh metal cylinder partially immersed in paint within the casing causes paint to lightly coat the periphery of the cylinder during rotation via the drive motor and for transfer to a soft absorbent material cylinder of a paint roller held in peripheral contact with the open mesh cylinder of the paint loader above the level of the paint within the casing. Excess paint readily drains from the open mesh cylinder prior to contact with the paint roller cylinder.

7 Claims, 2 Drawing Sheets

PORTABLE, MOTOR-DRIVEN PAINT ROLLER LOADER

FIELD OF THE INVENTION

This invention relates to the application of paint to a manually-held paint roller for rolling paint on the interior, exterior walls of a building structure or the like, and more particularly to a compact, easily disassembled and assembled, portable electric motor-driven paint roller loader which loads paint to the paint roller without excessive paint application and to such loader may be easily cleaned.

BACKGROUND OF THE INVENTION

Paint rollers, to a large extent, have replaced paint brushes for fast application of paint to interior or exterior building walls or the like. The paint roller is normally hand-held and includes a handle from which a bent wire extends of a length sufficient to hold a cylindrical felt or other soft, absorbant material cylinder with the cylinder mounted for rotation about its axis on a portion of the wire functioning as an axle for the roller. The roller is normally partially dipped within a mass of paint, conventionally maintained within an upwardly open, oblique bottom surface tray. The paint is manually applied to the periphery of the roller by physically rolling the roller along the inclined bottom wall of the paint tray, sufficient to coat the roller periphery. Upon partial immersion of the cylinder of the paint roller, usually an excessive amount of paint is applied to the roller periphery, resulting in dripping of the paint on the surface after paint application, i.e., paint running. Further, in moving the roller after immersion from the tray to an area of the wall, ceiling, floor, etc. being painted, some of the paint often drips from the roller during such transport.

Attempts have been made to eliminate the tray and to provide a more effective means for application of the paint to the rotating soft material cylinder or roller of the painting implement. In the commercial painting field, pumps or the like have been employed for pumping paint from a container or storage area to the paint roller cylinder. Both manually driven and motor driven paint roller coating apparatus have evolved due to the need for controlled paint flow to the periphery of the paint roller cylinder. The following U.S. patents are directed to attempts at solving the problem at hand: U.S. Pat. Nos. 3,135,000, 3,409,831, 3,648,322, 3,493,988, 4,107,815, 4,164,803 and 4,233,705.

While such apparatus have met with some success in supplying an even but light coating of paint to the periphery of porous material the soft cylinder mounted to the wire frame of the paint roller, the apparatus has failed to be light weight, portable, and readily movable across its floor while loaded from spot to spot within a room being painted. At the same time, the known apparatus fails to insure even coating of the soft material cylinder of the paint roller quickly and efficiently and without self application by the painter.

It is therefore an object of the invention to provide a compact, portable, easily assembled and disassembled, motor-driven paint roller loader which fully obviates the problems discussed above.

SUMMARY OF THE INVENTION

The invention is directed to a hand-carried portable, motor-driven paint roller loader which comprises an upwardly open rectangular, box-like casing formed by a horizontal bottom wall and four vertically upright side walls integrally joined to the bottom wall about edges thereof and forming laterally opposed front and rear walls, and longitudinally opposed end walls sealed at confronting edges. A hollow perforated, cylindrical roller assembly is mounted interiorly of the casing for rotation about its axis with its axis horizontal, and positioned between longitudinally opposed end walls. A drive motor is mounted to the casing and operatively coupled to the perforated roller for rotating the perforated roller about its axis. The hollow perforated cylindrical roller is positioned above the bottom wall such that the hollow perforated cylindrical roller picks up paint when partially immersed within the paint to cause a thin coating of paint to adhere to the outer surface of the hollow perforated cylindrical roller assembly during drive motor rotation thereof. The paint readily transfers to a soft, absorbent material cylinder of a manual paint roller in peripheral contact with the loader hollow perforated cylindrical roller, above the level of paint within said casing. A handle is pivotably coupled to opposite side walls of said casing, near the open top thereof, and spans across the open top for permitting the loader to be transported from spot to spot to meet the needs of the painter.

Preferably the drive motor is an electric motor mounted to the exterior of the bottom wall of said casing, with said electric motor including a shaft projecting horizontally beyond a side wall of said casing. A drive pulley is fixedly mounted to said motor drive shaft proximate to the exterior surface of said side wall. The hollow perforated cylindrical roller is mounted for rotation on an axle spanning between said side walls and having an end thereof projecting through the same casing side wall as that of said drive motor shaft. A driven pulley is fixedly mounted to said hollow perforated cylindrical roller axle, at the end thereof projecting through said side wall, and an elastic belt is leaved about said pulleys such that said belt frictionally drives said driven pulley upon energization of the electric drive motor.

The casing includes aligned cylindrical holes within respective side walls. Metal sleeve bearings are mounted within said hole sized to the diameter of the axle supporting said hollow perforated cylindrical roller assembly and receiving respectively opposite ends of said axle while sealably supporting said perforated hollow cylindrical roller mounting axle to prevent loss of paint from the casing interior through said sleeve bearings. The hollow perforated cylindrical roller assembly may have an axial length less than the distance between said laterally opposed side walls. A pair of circular discs are fixably mounted to a hollow cylindrical tube and an open mesh perforated cylinder having a diameter on the order of the diameter of said discs is fixedly mounted at opposite ends to respective discs. At least one of said discs includes an axially extending flange through which axle shaft projects. A tapped radial hole within said flange receives a set screw threaded thereto for engagement with said axle such that the driven axle may be inserted through the bearing within said one side wall of said casing, passed through the center of said hollow cylindrical tube, with the end of the driven axle, remote from said driven pulley projected through said sleeve bearing within said other of said side walls. Thus, the set screw upon rotation locks said hollow perforated cylindrical roller assembly to said driven axle to maintain said hollow perforated cylindrical roller assembly on said driven axle and in proper position within the interior of said casing for facilitation paint transfer to the exposed periphery of the open mesh cylinder. The set screw also facilitates ready disassembly of the hollow perforated cylindrical roller for cleaning of the interior of the casing after the hollow perforated cylindrical roller is removed, along with said driven axle, and the cleaning of the removed components.

Preferably, casters are mounted to the bottom wall of said box-like casing at the four corners thereof to facilitate rolling of said paint roller loader over an underlying horizontal support surface upon which the loader rests.

DESCRIPTION OF THE PREFERRED EMBODIMENT

Figure 1:
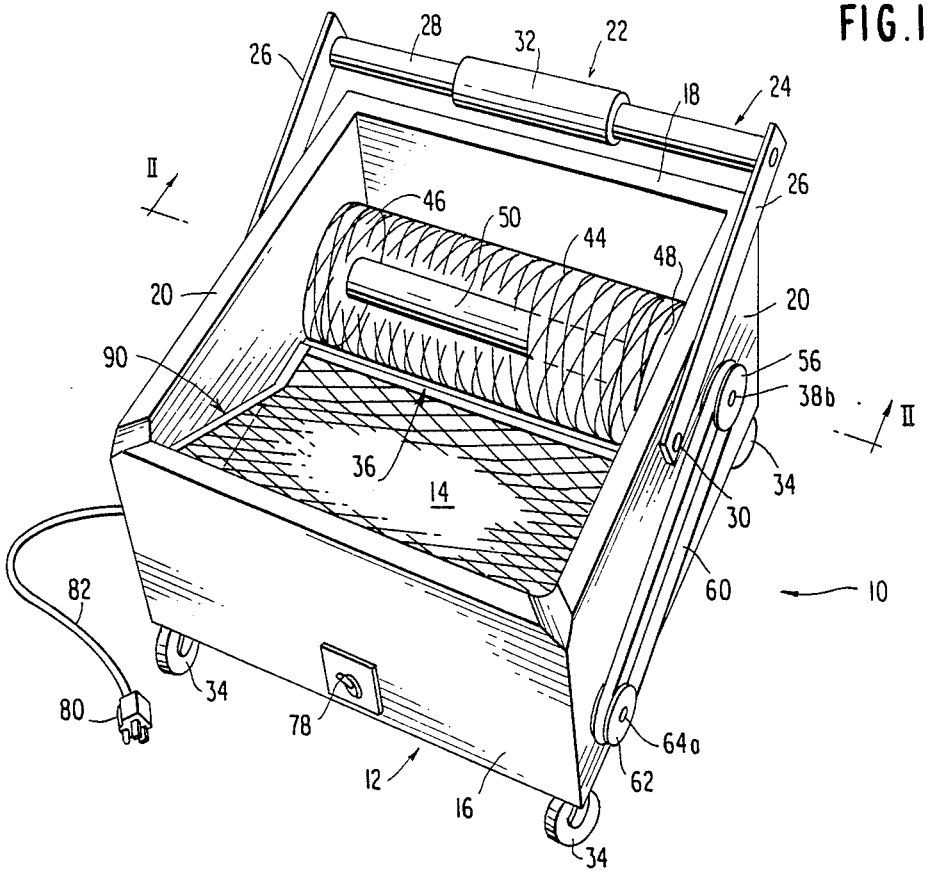
FIG. 1 is a perspective view of the portable, motor-driven paint roller loader forming a preferred embodiment of the invention.

Referring to the drawings, there is shown a preferred embodiment of the portable, motor-driven paint roller loader indicated generally at 10. A principle component thereof is an upwardly open parallelepiped form, box-like casing indicated generally at 12, and consisting of a bottom wall 14, a front wall 16, a rear wall 18 and laterally opposed side walls 20. The casing may be formed of sheet metal or of molded plastic, as long as the molded plastic body is not adversely affected by the paint carried thereby during use of the paint roller loader 10. Alternatively, an imperforate sheet metal liner (not shown) may be applied to the interior surfaces of walls 14, 16, 18, 20.

The unit is rendered portable, particularly through the use of a pivotable handle assembly indicated generally at 22, consisting of a U-shaped metal or molded plastic member 24 having a pair of laterally-spaced arms 26 integral with a right angle cross bar 28. Cross bar 28 is joined to the arms 26 at the opposite ends thereof. The arms 26 are pivotably mounted at free ends, opposite crossbar 28, by means of pins 30 fixedly mounted, i.e., embedded within the laterally opposed side walls 20 and centered front to back. A wooden or plastic dowel 32 provided with an internal bore, is rotatably mounted on the cross bar 28 and centered thereon. Dowel 32 is readily grasped by the hand of the user for raising the handle 24 to vertical, upright position, allowing the casing 12 to be lifted from the floor or other underlying horizontal support surface and moved at will throughout the room or other area being painted.

Figure 3:
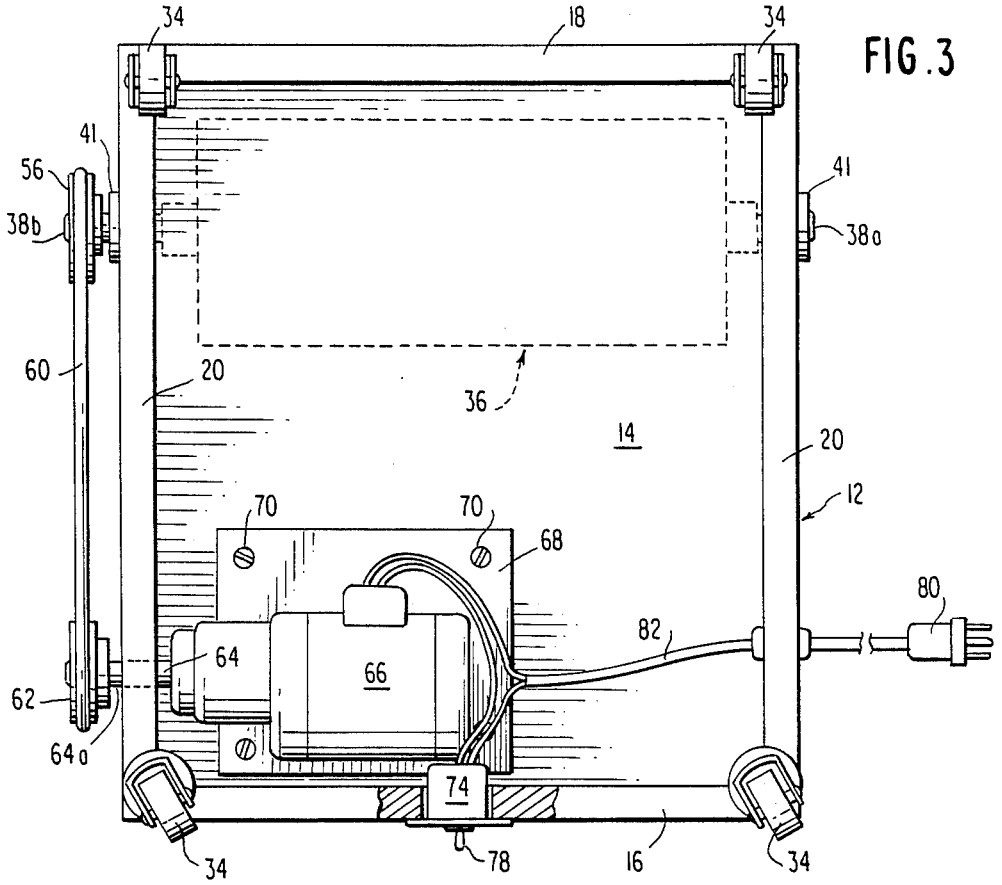
FIG. 3 is a bottom plan view of the loader of FIG. 1, showing the position of the electric drive motor and the on/off switch controlling same.

The portability of the paint roller loader 10 is also enhanced by the utilization of four casters 34 which are mounted to the casing 12 at the four corners thereof by way of drilled holes (not shown) within which holes **34*a*, the casters are inserted, FIG. 3**.

A principle aspect of the paint roller loader 10 is the nature and positioning of a hollow perforated cylindrical roller assembly indicated generally at 36. The perforated, hollow cylindrical roller assembly 36 is mounted for rotation about a horizontal axis interiorly of the upwardly open casing 12 by way of an axle 38. Axle 38 projects through bores 40 of metal sleeve bearings or bushings 41 formed of brass or the like, which, in turn, are press-fitted into aligned holes 42 within respective laterally opposed side walls 20, at some height above the casing bottom 14. The holes 42 are drilled or otherwise formed within the side walls 20 of the casing and axially aligned with each other. The outside diameter of the bushings 41 is slightly larger than the diameter of the holes 42 receiving the same so that the bushings are fixed to the casing 12. The bushings 41 have a bore diameter which is slightly larger than the diameter of the axle 38. Axle 38 rotatably mounts a perforated open mesh metal cylinder 44 forming the principle component of the hollow perforated cylindrical roller assembly 36.

In that respect, the open mesh cylinder 44 is fixedly mounted to and supported by a pair of circular discs 46, 48, which in turn are fixedly mounted to opposite ends **50*a* of a small diameter plastic tube 50 which is of a length in excess of the length of the open mesh cylinder 44. The tube ends 50*a* project through central holes 52 within the disc 46, 48. The projecting ends 50*a* form flanges for the discs. The tube 50 has an internal diameter which is slightly larger than the diameter of axle 38 such that the axle slides into the bore of tube 50. At least one end 50*a* of the tube 50 there is provided a tapped radial hole 51 which receives the threaded end of a set screw 53 for fixing the open mesh cylinder 44 via discs 46, 48 to the shaft 38** after assembly occurs.

Figure 4:
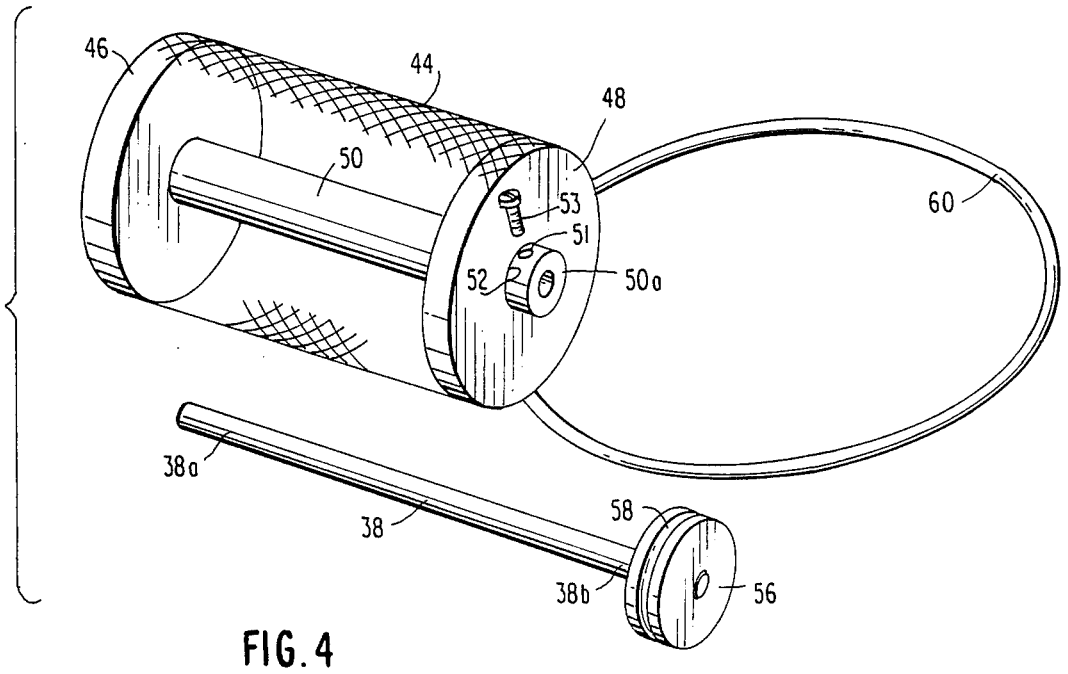
FIG. 4 is an exploded, perspective view of the hollow perforated cylindrical roller assembly forming a principle component of the paint roller loader of FIG. 1.

The sequence of assembly and disassembly of the perforated hollow cylindrical roller assembly may be seen from FIG. 4, which is an exploded perspective view of the components of that assembly including the driven axle 38. The perforated, open mesh cylinder 44 is positioned internally within the upwardly open casing 12 with tube 50 aligned with the bore holes 40 of the sleeve bearings 41. The driven axle 38 has both its ends **38*a*, 38*b* rotatably mounted within respective bushings or sleeve bearings 41. Further, a driven pulley 56 is fixedly mounted to end 38*b* of the driven axle prior to assembly so that the free end 38*a* of that axle is projected through sleeve bearing 41 within the right side wall 20 of the casing, FIG. 1, and thence through the hollow tube 50, from the end of the tube 50 proximate to disc 48. The projecting end 38*a* of the driven axle which extends outwardly of flange 50*a* of tube 50 is received within the sleeve bearing 41 fixedly mounted within the left side wall 20, FIG. 1, of the casing. By screwing down set screws 53, the perforated open mesh cylinder 44 is fixedly locked to axle 38 for rotation with that member. Further, the presence of the tube 50 fixedly locked to the axle 38 prevents the axle 38 from being removed from its bushings or sleeve bearings 41 which mount the axle at opposite ends to the casing. Driven pulley 56 is provided with a U-shaped groove 58 within its periphery, which frictionally receives the elastic drive belt 60**.

With the perforated, open mesh cylinder 44 mounted for rotation about its axis and with that axis horizontal within the casing 12, and spaced slightly above the bottom wall 14, the hollow perforated cylindrical roller assembly 36 can be driven in slow rotation about its axis, with cylinder 44 partially immersed in paint to a level L which is appropriately poured from paint can (not shown) into the interior of the upwardly open casing 12.

Figure 2:
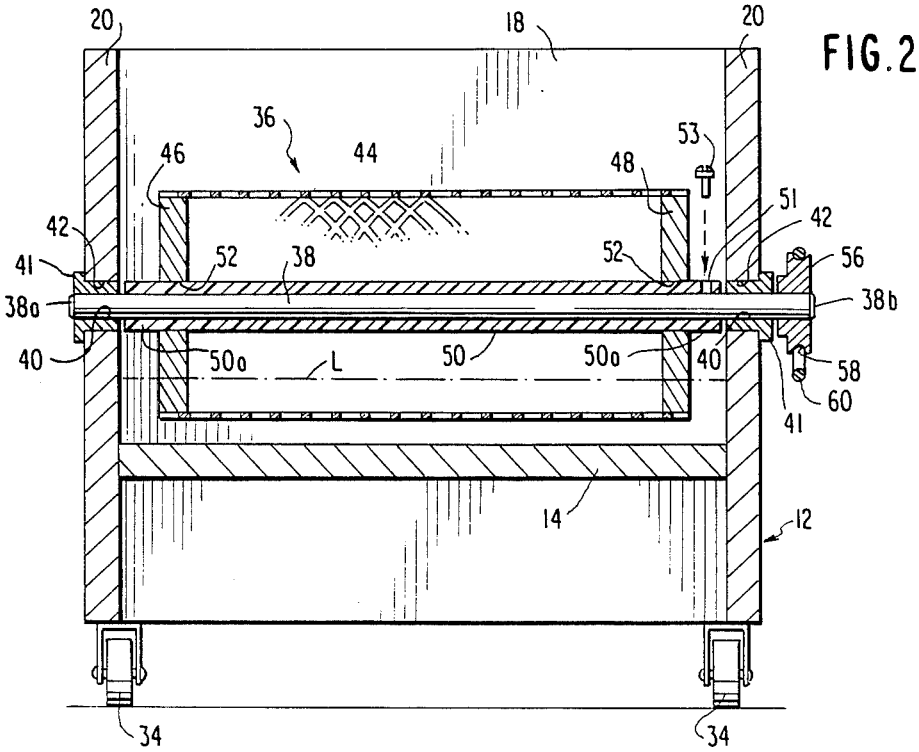
FIG. 2 is a vertical sectional view taken along lines II—II of FIG. 1.

A further aspect of the paint roller loader of the present invention is the fact that the perforated hollow cylindrical roller assembly 36, being driven at a set, slow speed, facilitates uniform transfer of paint onto the periphery of a manual paint roller absorbent material cylinder of the type in vogue for roller paint application to a flat wall surface or the like. As seen in FIG. 1, there is provided a second, driving pulley 62 which, in turn, is fixedly mounted to the end 64*a* of a motor drive or power shaft 64 of an electric motor 66, FIG. 3. The motor 66 is fixed to the bottom wall of casing 12 by a board 68 via screws 70, at opposite ends, which screws 70 are screwed into the bottom wall 14 of casing 12. The motor 66 has its power or drive shaft 64 projecting through side wall 20 adjacent a corner of the casing formed with front wall 16. The end of the power shaft 64 projects beyond the outside surface of the side wall 20 and has fixed thereto, drive pulley 62. Pulley 62 has a U-shaped groove within its periphery. A control switch 74 is mounted adjacent to the motor, and has a toggle switch actuator 78 projecting outwardly of the front surface of front wall 16. Further, wires of electrical cord 82 connect the switch 74 to the electrical motor 66 and extend to the opposite side wall 20 and terminate in a male electrical plug 80 at that side wall. Transmission is completed from drive pulley 62 to driven pulley 56, via elastic belt or band 60. The periphery of the drive pulley 62 has a groove matching that of pulley 56. By flipping of the switch 78, electric power is supplied from the male plug 80 to the electrical drive motor 66, energizing the same. Rotation of elastic belt or band 60 in a clockwise direction, FIG. 2, results in a clockwise rotation of hollow perforated cylindrical paint transfer roller assembly 36 applying fresh paint to the periphery of cylinder 44 until depletion of the paint within the interior of casing 12.

If desired or necessary, O-ring seals may be mounted inside the hollow sleeve bearings 41, sized less than but expanded slightly by passage of axle 38 therethrough to prevent escape of paint wetting the periphery of the paint roller cylinder when hand held against the outer periphery of the hollow perforated cylindrical roller assembly 36. The open mesh cylinder 44 may be formed of thin sheet metal, perforated in a pattern over the complete periphery thereof, from one axial end to the other. A flat open mesh screen 90 may be inserted into casing twelve and fixedly positioned at an oblique angle facing open mesh cylinder 44 to support the paint roller cylinder in contact with the cylinder 44. Excess paint can drop through the open mesh screen 90.

As may be appreciated, various changes may be made without departing from the spirit of the invention. For instance, O-ring seals may be mounted within the same bores of side walls 20 housing the brass sleeve bearings and adjacent thereto, with the O-rings being squeezed slightly so as to maintain an appropriate seal against the periphery of the removable driven shaft or axle 38. The bottom wall 14 may be at a raised position with respect to the lower edges of the casing front wall, rear wall and side walls to permit the motor 66 to be raised off the floor when casing 12 is positioned upright, as per FIG. 1. The resilient, elastic belt 60 is stretched somewhat when leaved about both pulleys 56, 62, so that the drive is essentially a frictional drive between the belt and the grooved surfaces of respective pulleys.

From the description above, it is evident that in use a paint roller whose soft absorbent material cylinder is placed parallel to and in surface contact with the outer periphery of the hollow perforated cylindrical roller 44 of assembly 36. The toggle switch 78 is flipped to change state, thus energizing the motor 66 to drive the loader cylinder 44 in a slow, clockwise rotation. With the paint roller absorbent material cylinder positioned in surface contact with the periphery of paint holder cylinder 44 above the level L of the paint within the casing 12, the paint will coat the perforated metal cylinder 44. Due to the mass of perforations, i.e., openings, in the open mesh cylinder 44, most of the paint will rapidly drip back into the casing 22 with a correct (thin) coating of paint adhering to the outer periphery of the cylinder 44 for transfer during rotation onto the periphery of the paint roller absorbent material cylinder.

The roller loader 10 saves both the amateur and professional painter time and effort in the task of applying paint to the manually held paint roller. Instead of taking the paint roller, and having to go through the effort of self loading the paint roller from a tray or bucket, the painter can make light surface contact of the paint roller absorbent cylinder with the outer periphery of the perforated metal cylinder 44. The paint roller is loaded in two seconds or less with no effort on the part of the painter. The roller loader 10 will apply the correct amount of paint to the painter's paint roller. The open mesh surface provided by cylinder 44 permits the excess paint to rapidly drain from the intercese of the cylinder 50 back into the casing 22.

Importantly, the unitary nature of the loader 10 permits the loader to be easily cleaned after use. The unit can be cleaned in ten minutes or less by rapid disassembly, and after cleaning, quick reassembly which may be accomplished in about one-fifth the time of disassembly. Of course, the size of the loader, and particularly the casing 22, may vary, but the position of the perforated cylinder 44, of roller assembly 36, remains set. It is spaced slightly from the upper surface of bottom wall 14, and a quart or so of paint may be poured into the interior of the upwardly open casing 22 to a level L, such that only the bottom of cylinder 44 is immersed within the paint. The unit may be tilted such that most of the paint will be forced into the area of contact with cylinder 44. Disassembly after use can be easily and rapidly accomplished in a preferred sequence. First the elastic drive belt 60 is removed by further expanding it and lifting it off one of the pulleys, and then the other. In a second step, a safety plate may be removed from the interior side wall of the casing adjacent the cylinder 44. A screw driver readily removes one or more screws mounting safety plate adjacent the top and to one side of the cylinder 44. In order to remove the roller assembly 36, first the release of the set screw fixing the cylinder 44 via tube 50 on the drive axle 38 is accomplished. Thereafter, the axle 38, with its driven pulley 56, is pulled axially from the casing 22 by removing the axle from the sleeve bearings or bushings 41 mounting the same. The interior of casing 22 is now free for cleaning after physically lifting the cylinder 44 from the interior of that unit. Any paint retained within the casing 22 may be poured out through a grooved or recessed pouring spout 84, spouts 84 are at opposite corners between the front wall 16 and the laterally opposed side walls 20. The pouring may be facilitated by use of the carrying handle 24, which acts as a fulcrum when tilting the casing 22 to pour out any unused paint. Cleaning of all parts may be accomplished by use of a solvent or with water, depending upon the nature of the paint employed in the painting operation. Reassembly involves reversing the steps described above with respect to disassembly of the unit.

While an embodiment of the invention has been described in detail, it will be evident to those skilled in the art that the invention may be embodied otherwise without departing from its spirit and scope.

What is claimed:

1. A portable, motor-driven paint roller loader comprising:

an upwardly open, rectangular, box-like casing including a horizontal bottom wall, four vertically upright walls integrally joined to the bottom wall about respective edges thereof and forming laterally opposed front and rear walls, and longitudinally opposed end walls sealed at confronting edges, a hollow, perforated cylindrical roller assembly mounted interiorly of the casing for rotation about its axis, and extending horizontally between longitudinally opposed end walls, a drive motor mounted to said casing, means operatively coupling said motor to said hollow perforated cylindrical roller assembly, said hollow perforated cylindrical roller assembly being positioned above the bottom wall whereby, rotation of the hollow perforated cylindrical roller assembly causes, when partially immersed within paint carried by said casing, a thin coating of paint to adhere to the outer periphery of the hollow perforated cylindrical roller assembly during drive motor rotation thereof for ready transfer to a soft, absorbent material cylinder of a paint roller, manually held and parallel to and in peripheral contact with the loader hollow perforated cylindrical roller assembly, above the level of paint accumulated within said casing.

2. The portable, motor-driven paint roller loader as claimed in claim 1, further comprising a handle extending across the open top of said casing comprising a cross bar integrally joined to right angle, parallel arms at opposite ends of the cross piece, and means for pivotably coupling the ends of the arms remote from said cross bar to opposite sides of the casing at the center of said side walls, thereby permitting the loader to be transported from spot to spot to meet the needs of a painter.

3. The portable, motor-driven paint roller loader as claimed in claim 1, wherein said drive motor is an electric motor mounted to the exterior of the bottom wall of said casing, said electric motor including a shaft projecting outwardly from an end thereof beyond one of said side walls of said casing, a drive pulley fixedly mounted to the motor drive shaft proximate to the exterior surface of said one side wall, said hollow, perforated cylindrical assembly including an axle spanning between said side walls, and having opposite ends thereof projecting through opposite casing side walls, and being rotatably mounted thereon, said axle extending parallel to said electric motor shaft, a driven pulley fixedly mounted to the axle at the end thereof projecting through said one side wall, and an elastic belt leaved about said pulleys such that by energization of said motor, said belt frictionally drives the driven pulley through said drive pulley.

4. The portable, motor-driven paint roller loader as claimed in claim 3, wherein said casing includes aligned cylindrical holes within respective side walls thereof, metal sleeve bearings are fixedly mounted within said holes having bores sized slightly larger than the diameter of the axle of said hollow, perforated cylindrical roller assembly and receiving opposite ends of said axle respectively, and means for sealing said axle at said sleeve bearings to prevent a loss of paint from said casing interior through said sleeve bearings.

5. The portable, motor-driven paint roller loader as claimed in claim 4, wherein said hollow, perforated cylindrical roller assembly, further comprises a hollow, cylindrical tube rotatably mounted on said axle and of a length less than said distance between said laterally opposed side walls, a pair of circular discs are fixedly mounted to respective ends of said hollow cylindrical tube, and a open mesh perforated cylinder having a diameter on the order of the diameter of said discs are fixedly mounted at opposite ends to respective discs, and means fixing at least one of said discs to said axle such that said open mesh cylinder, said circular discs and said hollow tube rotate with said axle.

6. The portable, motor-driven paint roller loader as claimed in claim 5, wherein said at least one disc includes an axially extending flange concentric to said axle, a tapped radial hole is provided within said flange, a set screw threaded in said hole engages said axle to lock said at least one disc to said axle, such that said axle may be inserted through said sleeve bearing within said one side wall and through the center of said hollow cylindrical tube, and the end of said driven axle remote from said driven pulley projected through said sleeve bearing within said other of said side walls, and with said set screw locking said hollow perforated cylindrical roller assembly to said driven axle said assembly is maintained in proper position within the interior of the casing for facilitating paint transfer to the periphery of the open mesh cylinder during rotation.

7. The portable, motor-driven paint roller loader as claimed in claim 6, further comprising casters mounted to the bottom wall of said box-like casing at respective corners thereof to facilitate rolling of the paint roller loader over an underlying horizontal support surface upon which the loader may rest.

* * * * *